US008123009B2

(12) United States Patent
Satterfield

(10) Patent No.: US 8,123,009 B2
(45) Date of Patent: Feb. 28, 2012

(54) SMALL BAG CONNECTOR ASSEMBLY

(75) Inventor: Richard C. Satterfield, Wellesley, MA (US)

(73) Assignee: Channel One Communications, Inc., Needham, MA (US)

( * ) Notice: Subject to any disclaimer, the term of this patent is extended or adjusted under 35 U.S.C. 154(b) by 244 days.

(21) Appl. No.: 12/473,370

(22) Filed: May 28, 2009

(65) Prior Publication Data

US 2009/0294236 A1 Dec. 3, 2009

Related U.S. Application Data

(60) Provisional application No. 61/056,567, filed on May 28, 2008.

(51) Int. Cl.
*A45C 13/38* (2006.01)

(52) U.S. Cl. ..... 190/108; 150/111; 383/37

(58) Field of Classification Search ..... 190/102, 190/108, 110; 150/111, 113; 383/37; 224/252, 224/253, 266, 267, 904; 294/145, 149–151
See application file for complete search history.

(56) References Cited

U.S. PATENT DOCUMENTS

| | | | | |
|---|---|---|---|---|
| 4,177,909 | A * | 12/1979 | Haskell | 224/153 |
| 4,708,243 | A * | 11/1987 | Nailon | 206/315.11 |
| 4,895,198 | A * | 1/1990 | Samuelson | 150/138 |
| 5,529,322 | A * | 6/1996 | Barton | 280/30 |
| 5,628,443 | A * | 5/1997 | Deutsch | 224/583 |
| 5,730,264 | A * | 3/1998 | Lu | 190/108 |
| 6,070,888 | A * | 6/2000 | Wang | 280/37 |
| 6,899,346 | B2 * | 5/2005 | Pfeiffer | 280/47.29 |
| 7,036,641 | B2 * | 5/2006 | Russo et al. | 190/18 A |
| 2006/0180624 | A1 * | 8/2006 | Sadow et al. | 224/582 |
| 2006/0226619 | A1 * | 10/2006 | Sadow | 280/47.26 |
| 2006/0260893 | A1 * | 11/2006 | Drew et al. | 190/108 |
| 2007/0228097 | A1 * | 10/2007 | Recanati | 224/580 |

* cited by examiner

*Primary Examiner* — Sue Weaver
(74) *Attorney, Agent, or Firm* — Cesari and McKenna, LLP

(57) ABSTRACT

A connector with a flexible arrangement for attaching one or more small or mid-sized bags is described. The connector provides a shoulder strap or handle that allows the user to conveniently carry the assemblage. The connector may include slotted top and bottom rails vertically displaced from each other, where mounting tabs on the small bags may be threaded through the slots to attach a bag to the connector. Slotted sheets of material may be placed between a top and bottom rail, or the entire connector may be made of one or more sheets of fabric or other flexible material. Again the mounting tabs may be threaded through the slots to secure the bags. The vertical edges of the sheets may be folded and sewn of bonded to better form supports for the connector, and combinations of rails, vertical supports and sheets of fabric of other such materials may be used.

2 Claims, 6 Drawing Sheets

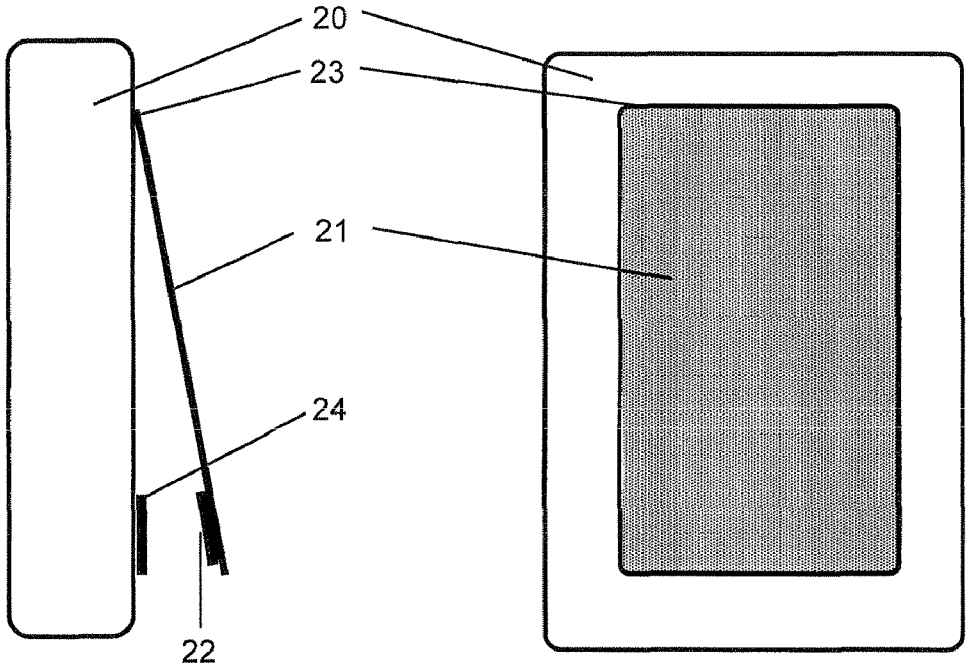
FIG. 4A
FIG. 4B
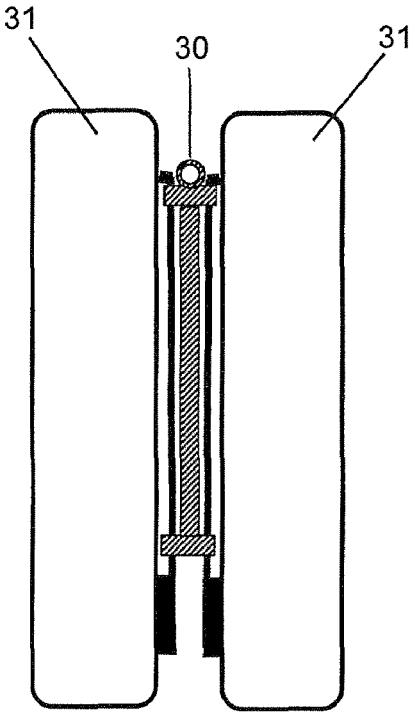
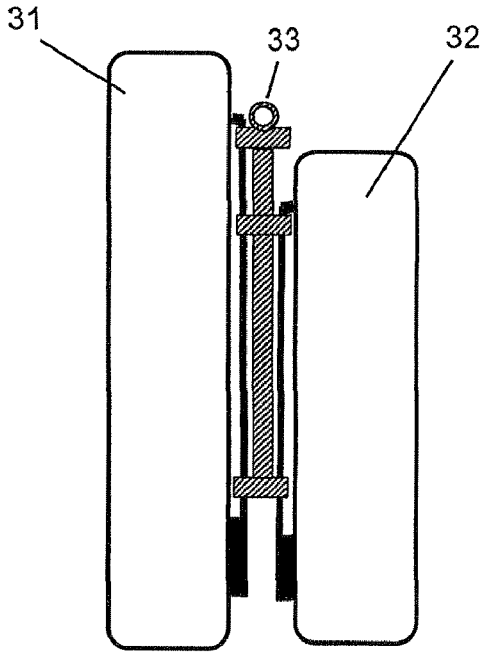
FIG. 5A
FIG. 5B

SMALL BAG CONNECTOR ASSEMBLY

RELATED APPLICATIONS

The present application claims priority from a provisional patent application, filed May 28, 2008, Ser. No. 61/056,567, of common title, inventorship and ownership with the present application. This provisional application is incorporated herein by reference.

FIELD OF THE INVENTION

The present invention relates to an apparatus and method increasing the utility, functionality and convenience of a flight bag having small detachable side bags that are normally attached to the larger flight bag. This type of flight bag is used by pilots in general and commercial aviation. The invention allows a pilot the ability to reconnect these small bags together with a shoulder strap so that they may easily be carried together without having to bring along the main flight bag at the same time. Hence the functionality and size of the assemblage of bags may be changed to suit the user's needs.

BACKGROUND OF THE INVENTION

Pilots may not always fly the same plane and consequently carry equipment, air charts, airport directories, and landing information books as well as an emergency radio, portable GPS unit and a radio headset. During a stopover the pilot may not want to leave their headsets, GPS unit or emergency radio in a plane while it is parked at an airport.

This invention allows a pilot to take his expensive equipment with him by reconfiguring his flight bag into a smaller unit that can go with him while the main part of the flight bag stays with the plane. Therefore, this invention gives a pilot the flexibility to change the size of his flight bag while keeping the ability to conveniently carry it around with him.

SUMMARY OF THE INVENTION

The present invention provides this flexibility and other advantages with a connector assembly and method having the ability to convert into one carrying unit; one or more of the smaller detachable bags. Usually the shoulder strap from the main flight bag or a handle is attached to the connector assembly.

In preferred embodiment the connector assembly is a thin rectangular (herein, rectangular includes square) structure of several forms, for example: a rigid rectangular frame with top and bottom rails and side supports; a flexible frame with top and bottom rails and a flexible sheet connecting the two rails; a flexible rectangular sheet; two flexible rectangular sheets sewn or bonded together to form a two ply sheet; or a rectangular frame incorporating a combination of the other embodiments. In each of these embodiments, a handle or shoulder strap may be attached, and slots are arranged within the rigid or flexible rectangular frame or the rails that accommodate mounting tags that secure bags to the connector.

The flexible sheets may be of canvas or fabrics, including cloth, nylon, woven metallic-type fabrics or other man-made materials or composites.

In other combinations additional intermediate cross rails may be arranged between the top and bottom of the connector.

The top rail or edge may includes loops, eyelets or hooks or the like to which a handle or shoulder strap may be attached for ease of carrying. Vertical supports, when employed, extend from the top rail to the bottom rail and may be attached at the distal ends of the corresponding top and bottom rails. Additional rails similar to the top and bottom rails may be located between the top and bottom rails. In this embodiment the rails may have through slots through which mounting tabs may be threaded that secure bags to the connector.

In the embodiment that includes one or two flexible sheets the top, bottom and the vertical edges of the sheet may be doubled and sewn to impart form to the connector. Through slots may be formed in the sheet material to accommodate the mounting tabs for bags. In other embodiments the top and bottom edges may be opened allowing a mounting tab from one or more bags to be threaded through the open top, out the open bottom, and joined back to the bag securing it to the connector.

In another embodiment the connector includes at least two horizontal cross members arranged vertically from each other. These two cross members may be joined to a vertical sheet. In this embodiment, the side edges of the vertical sheet may be doubled and sewn to impart some rigidity to the connector. Through slots in the top and bottom rails and in the sheet may be formed to accommodate the mounting tabs of bags.

BRIEF DESCRIPTION OF THE DRAWINGS

FIG. 4A is a side view of what a typical small mounting bag showing the mounting tab and Velcro used to keep the tab closed;

FIG. 4B is a diagram of the back of a typical small bag;

FIG. 5A shows two of the same sized bags attached together using a connector as shown by FIG. 1A through FIG. 1C;

FIG. 5B shows two different sized bags attached together using a connector as shown in FIG. 2A through 2C;

DETAILED DESCRIPTION OF PREFERRED EMBODIMENTS

Figure 1A:
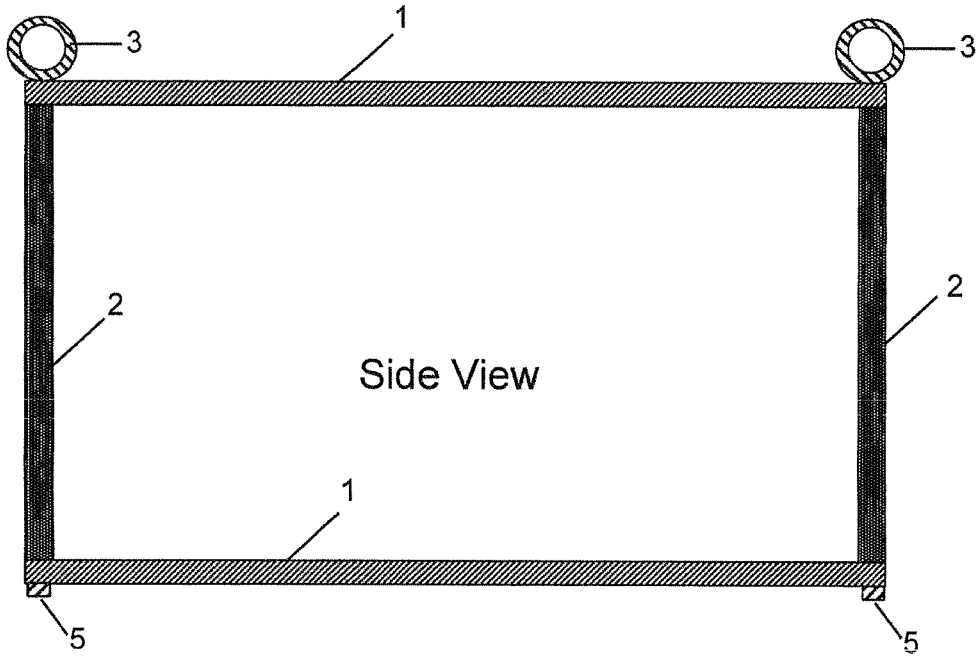
FIG. 1A is a side view of a two cross piece skeletal connector assembly having a single mounting slot.
Figure 1B:
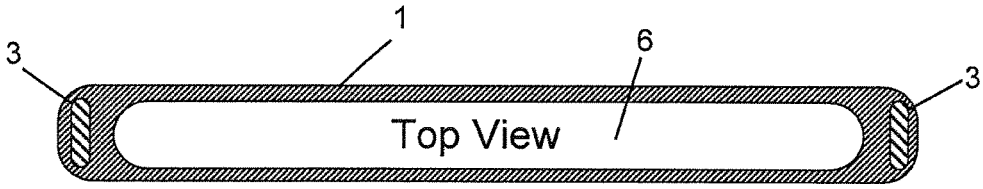
FIG. 1B is a top view of the connector assembly shown in FIG. 1A.
Figure 1C:
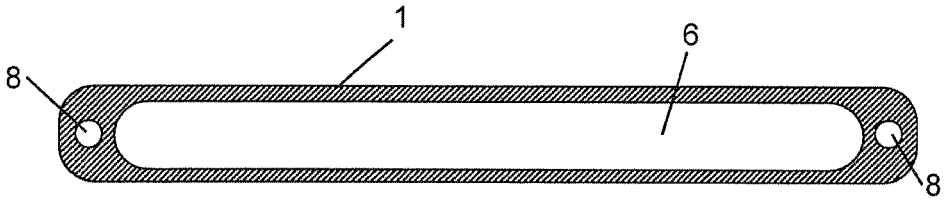
FIG. 1C is a drawing of a cross piece for this assembly.

A single slot connector shown in FIG. 1A through FIG. 1C consists of two cross pieces or rails 1 spaced apart by two vertical supports 2 extending through holes 8 in rails. The rings 3 allow a shoulder strap or a handle to be attached to the assembly, and the bottom cross member may be held on by a mechanical fastener 5. The cutout or vertical slot 6 allows for mounting tabs of one or two bags to be attached to the unit.

The mounting tabs are flaps attached, usually, at the top of a bag that may be threaded through the vertical slot 6 in one of both and reattached at the bottom of the bag. The bottom attachment may be via VELCRO or snaps, hooks or other such mechanisms as are known in the art. When so attached the bag is securely held to the connector.

In one preferred embodiment, the cross pieces 1 are made from wood or a metal such as aluminum, and the vertical supports 2 may be wood, metal, plastic or tubing with metal reinforcements. In another embodiment the vertical supports may be flexible tubing with internal reinforcements, not shown, where they attach to the cross rails. Typically, the shoulder strap mount 3 may be a small eyebolt, and the mechanical fastener 5 may be a screw, rivet or a nut threaded onto a tapped extension from the vertical supports 2. Other variations include making the connector assembly by injection molding of a plastic material or some combination of plastic, metal, wood or some other material. The eyebolt 3 may be formed from bent wire or rod, or it can be made from a more flexible material such as webbing, plastic, fabric or leather which is suitably attached to the vertical supports 2.

Figure 2A:
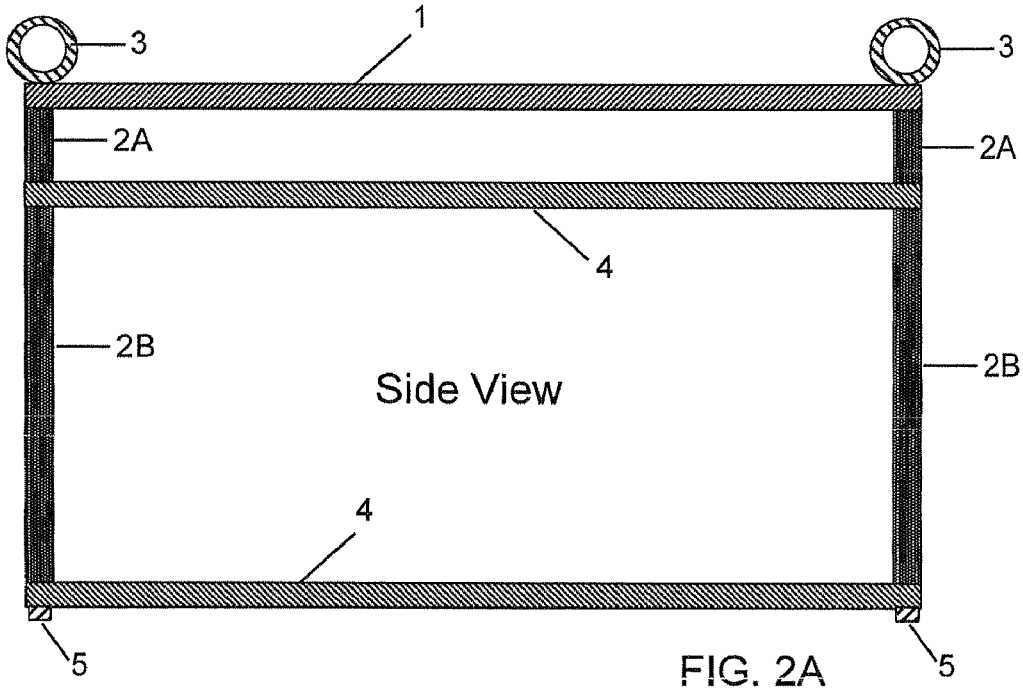
FIG. 2A is a side view of a three cross piece skeletal connector assembly having two different sized slots for mounting bags.
Figure 2B:
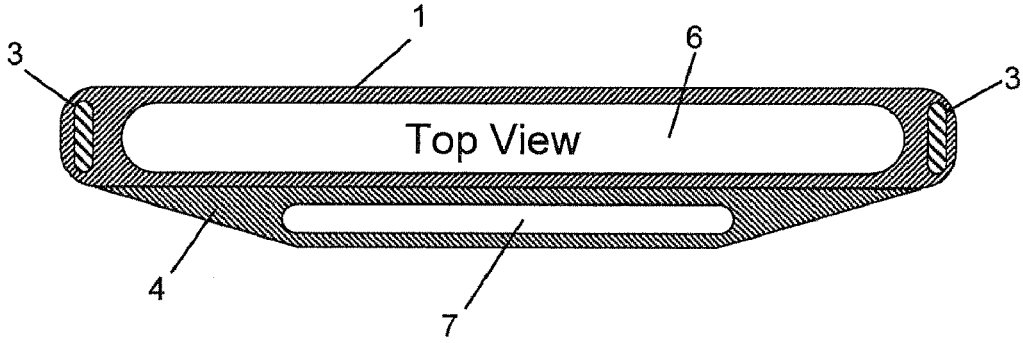
FIG. 2B is a top view of the three cross piece assembly.
Figure 2C:
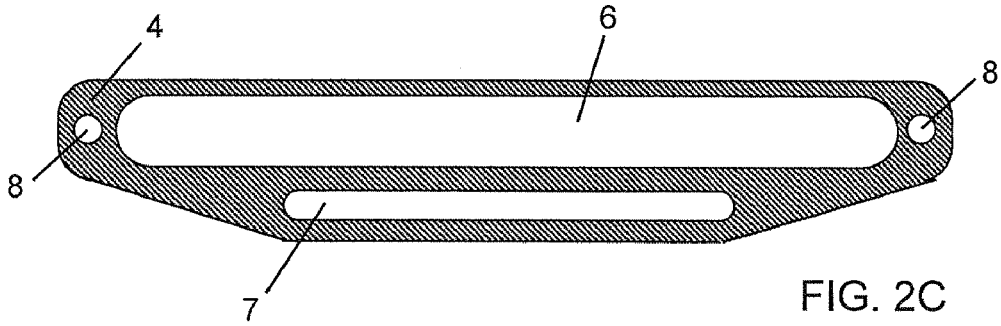
FIG. 2C is a drawing of the lower two cross pieces of the three piece connector assembly.

The two slot connector shown in FIG. 2A through FIG. 2C, consists of the same larger cutout 6, as in FIG. 1A through FIG. 1C as well as a smaller cutout 7. Typically small mounting bags come in two sizes. The larger bag is for aviation headsets, while the smaller bag is for a radio, GPS unit or a bottle of water. The smaller slot 7 allows the smaller bag to be attached without horizontal sliding. When a smaller radio bag is not being used, two of the larger, headset bags can still be attached through slot 6 because the backs of the bags are soft and will conform to the slight protrusion formed by the material needed to form the smaller slot 7. Again, the shoulder strap or handle attachment is typically an eyebolt and the mechanical fastener 5 is usually a small screw, though it could also be a small rivet. In another embodiment, the mechanical fastener 5 is a small clip or nut attached onto the end of a long eyebolt. Again, the eyebolt may be formed from bent wire or rod, or it can be made from a more flexible material such as webbing, plastic, fabric or leather that is suitably attached to the vertical supports 2A and 2B. In this embodiment, the top cross rail 1 is shown by FIG. 1C, while the middle and bottom cross rails are shown by FIG. 2C. FIG. 2B is a top view that shows the middle cross piece jutting out slightly away from the outline of the top piece 1.

Figure 3A:
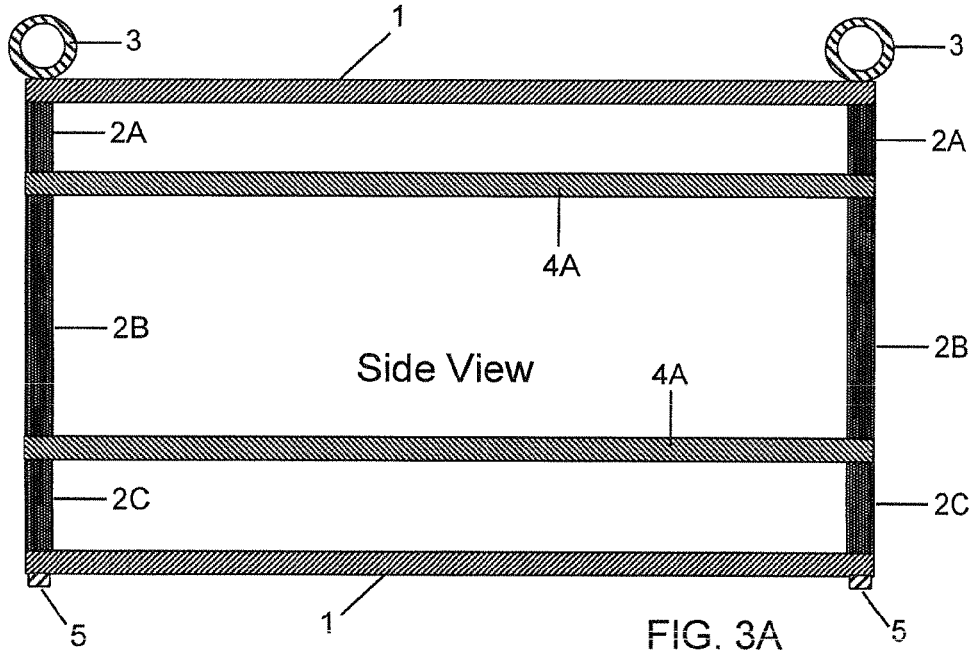
FIG. 3A is a side view of a four cross piece skeletal connector, having four mounting slots.
Figure 3B:
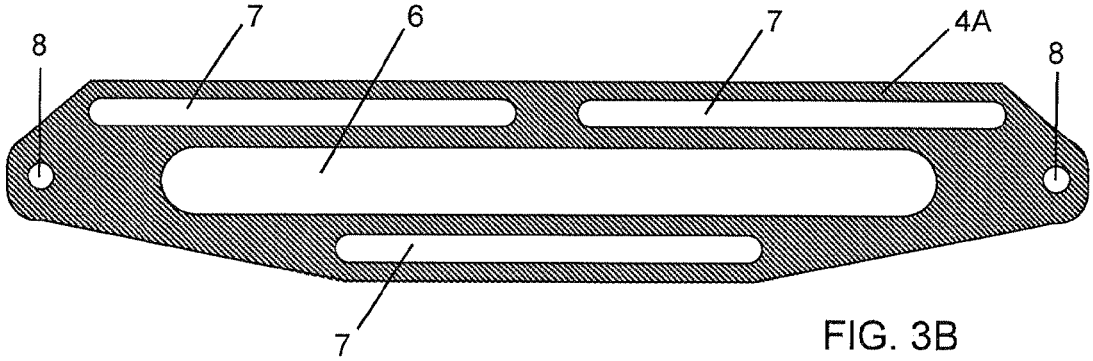
FIG. 3B is a drawing of the two middle cross pieces used in the connector.

The four slot connector shown in FIG. 3A and FIG. 3B, still has the main mounting slot 6 and three small slots 7. This configuration allows two headset bags, one headset and one or two radio bags, or three radio bags to be connected together at the same time.

In FIG. 3A, the vertical support 2B is now subdivided so that the vertical assembly consists of supports 2A, 2B and 2C on each side extending through holes 8 in the rails. The top and bottom cross rails are again shown by FIG. 1C and the two middle cross rails 4A are shown by FIG. 3B.

FIG. 4A is a side view of a headset or radio bag consisting of the bag itself 20, a mounting tab 21 hinged at 23 with Velcro loop and hook material 24 and 22 attached to the bag and the tab so that the bottom of the tab can be kept closed.

FIG. 4B is the back view of one of these small bags showing the positioning of the tab on the back of the bag.

FIG. 5A shows two of the same sized bags 31 being connected by a connector assembly 30 as diagramed by FIGS. 1A through 1C. If the connector assembly is short enough and made using cross pieces shown by FIG. 1C or FIG. 2C, then two of either sized bags could be used at the same time. If the connector from FIG. 1C is used, the smaller bag will tend to slide, which is one of the reasons for the narrower slot shown by FIG. 2C.

In another embodiment, two cross rails from FIG. 2C are used with shorter vertical supports 2 from FIG. 1A. When this is done the bottoms of the headset and radio bags are at different heights. If the bags are allowed to slide, then the assembly will usually not fall over when placed on the ground because the sliding of the mounting tabs and bags adjusts for the height difference.

FIG. 5B shows two different height bags 31 and 32 being connected by an assembly 33 as diagrammed by FIGS. 2A through 2C. In this illustration, the larger headset bag 31 is shown as being taller than the smaller radio bag, 32. The middle cross piece on the connector, FIG. 2A top element 4, is slightly below the top cross piece, FIG. 2A element 1, so as to compensate for the height difference of the bags. This allows the bags to more easily stand up when placed on the ground without having to slide while joined.

Figure 6A:
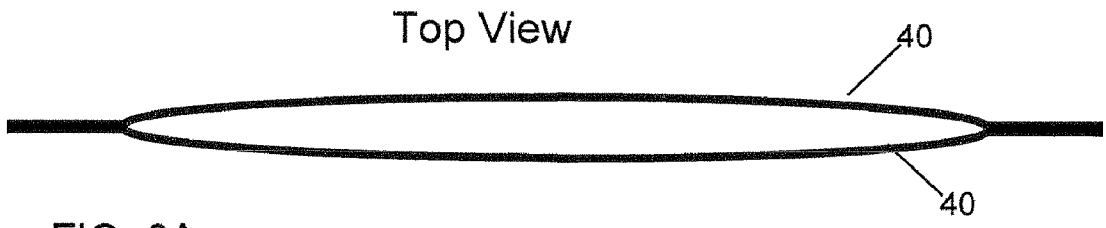
FIG. 6A shows a top view of a single slot connector made from a flexibly fabric or material.

FIG. 6A is a top view of a connector made from a flexible material such as leather, urethane laminated nylon or a plastic film. The connector consists of two pieces of material 40 connected together at the side so as to form a slot in which the mounting tabs of the bags may be placed.

Figure 6B:
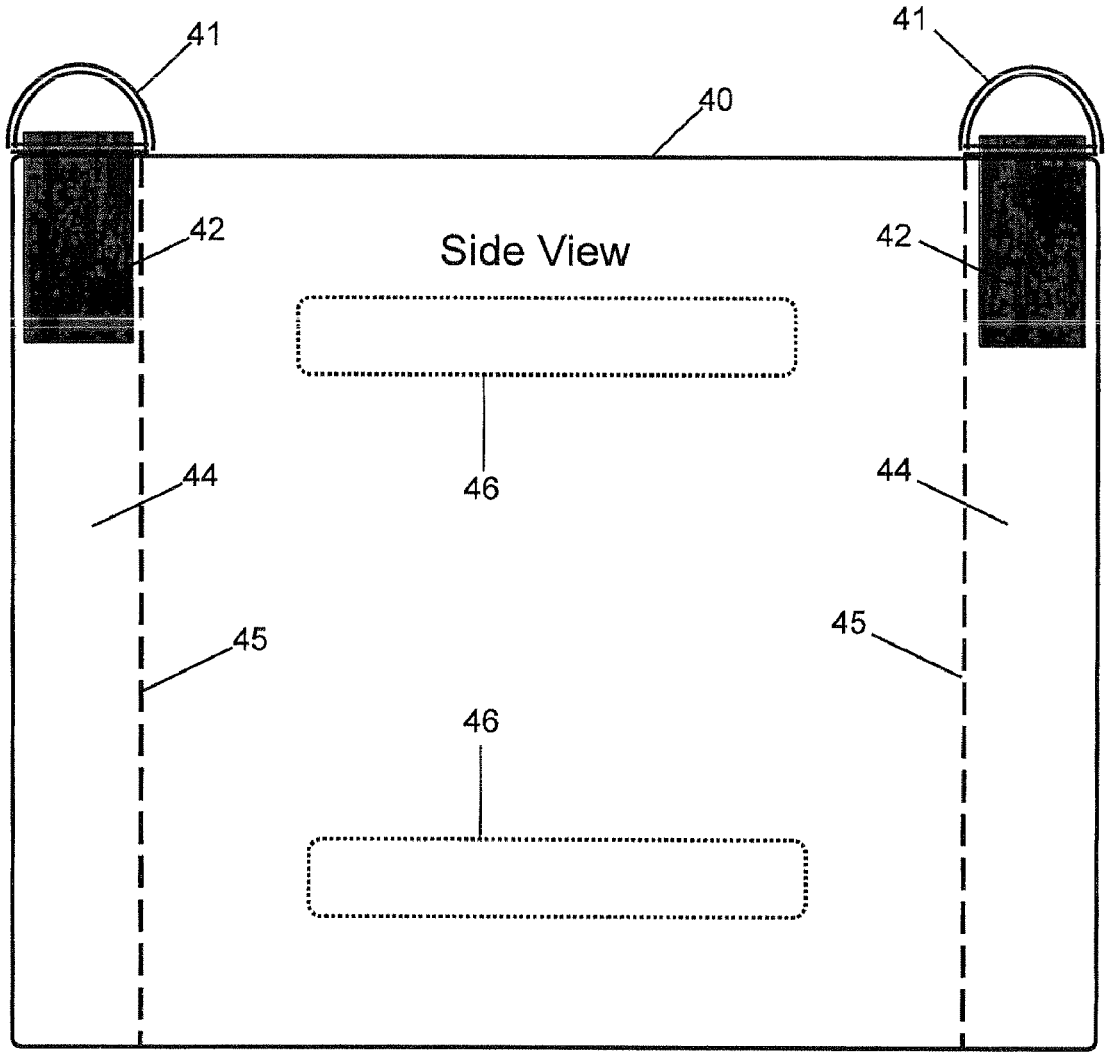
FIG. 6B shows a side view of the same connector as shown by FIG. 6A.

FIG. 6B is a side diagram of this flexible material connector assembly. The two pieces are attached by sewing, RF welding, fusing or gluing. The width of the mounting slot is the area between the two dashed lines 45. The rectangular areas 46 are optional cutouts which as previously discussed allow for the smaller bags mounting slot to be inserted in the top cutout and out the bottom cutout. In another mounting scheme, the smaller mounting tab goes in at the very top, out through the top cutout, back in through the bottom cutout and then out the bottom of the assembly. "D" rings 41 are typically used, but again, other mounting material consisting of webbing, plastic, or metal may be used to attach the shoulder strap to the assembly. The "D" rings 41 are shown being attached by pieces of material 42. In one preferred embodiment, this material is a urethane laminated nylon fabric that is attached by RF-Welding. In another embodiment, the material 42 is a strip of aluminum folded over and riveted to the sides. In yet another embodiment, nylon or polyester webbing is used and the combination is sewn, glued or riveted together. A leather material may also be used, but care should be exercised because the leather stretches and the "D" rings may rotate in use. The side areas 44 may optionally be internally reinforced with fabric or webbing to help distribute the weight through the connector side material.

Figure 7A:
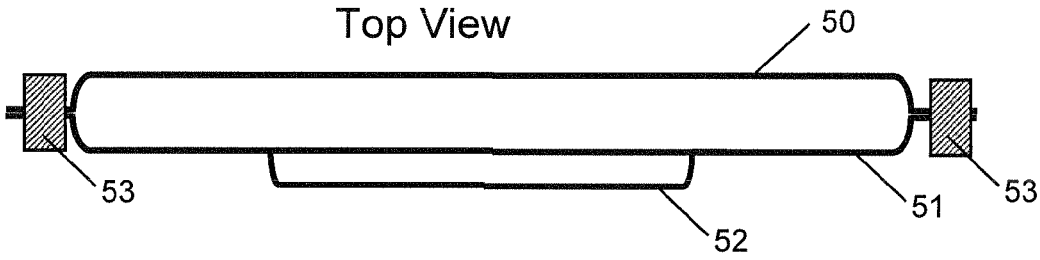
FIG. 7A shows a top view of a two slot connector made from a thin rigid material.
Figure 7B:
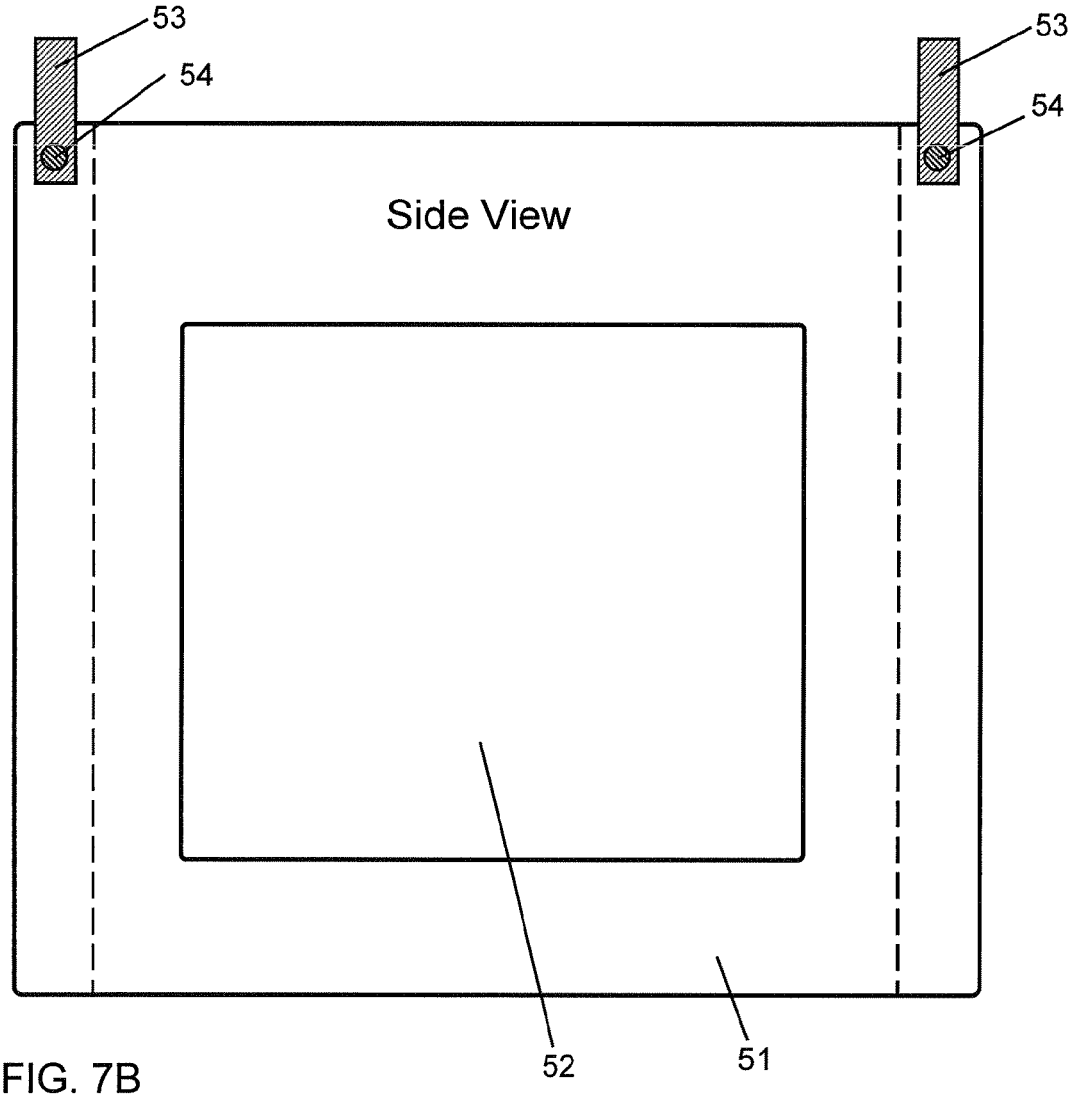
FIG. 7B is a side view of the same rigid connector.

FIG. 7A is a top view of another connector assembly made from a more rigid material. This material may be metal, wood or plastic and two mounting channels 50 and 52 are shown. The small channel 52 is also shown in FIG. 7B as element 52 and may be made by stamping or embossing the side material 51. The resulting channel 52 allows a small radio bag to be attached through this channel. A channel is a covered path way that extends, in FIG. 7B, from the opening at the top of channel 52 to a corresponding opening at the bottom of the channel 52.

The shoulder strap is attached to the loops 53 which are riveted 54 to the connector. In another embodiment, not shown, this mounting loop is eliminated and a hole is made in the side area. This shoulder strap clip can then attach at that point. To someone skilled in the art, other means of attachment of the shoulder strap may also be used. The two sides 50 and 51 of the connector may be combined by spot welding, gluing, or if designed properly, snapping together. In yet another embodiment, an attachment for the shoulder strap consists of metal eyebolts molded into the rigid parts, where the parts may be injection molded and formed singly as 50 and 51 or as a single part which combines 50 and 51 together. In a similar manner as shown by FIG. 3B, multiple additional mounting channels may be formed by adjusting the width of the channels 50 and 51 and stamping or embossing additional mounting channels, not shown.

It should be noted that even though the title and preferred embodiments of the present application are directed to smaller bags, the invention may be advantageously applied to large suitcase sized luggage and even large bags may benefit from the present invention.

What is claimed is:

1. A connector assembly for connecting together and carrying bags back to back, said assembly comprising:

a thin, flat, generally rectangular connector having a top edge, a bottom edge and opposite faces between said edges;

a first vertical slot at or near the top edge; and a second vertical slot at or near the bottom edge, said slots being in vertical attachment so that they can both receive the same elongated mounting tabs extending from the backs of bags positioned against said opposite faces of the connector;

a lifting device mounted to the top edge;

a pair of bags positioned opposite faces of the connector, each bag having an upper end, a lower end, a front, a back and an elongated mounting tab having a first end anchored to the back of the corresponding bag and a second end, said tab extending down through said first and second slots, and a fastening device for releasably fastening the second end of each strap to the back of the corresponding bag near the lower end thereof so that the backs of the bags are secured to the opposite faces of the connector.

2. A method of connecting together and carrying bags, said method comprising the steps of providing a connector assembly as defined in claim 1;

providing at least two bags, each having an elongated mounting tab one end of which is connected to the corresponding bag and a second end;

positioning the at least two bags against opposite faces of the connector;

threading the tab of each bag through the first and second slots of the connector assembly;

securing the second end of each tab to the corresponding bag, and raising the connector assembly and bags by means of said lifting device.

* * * * *

UNITED STATES PATENT AND TRADEMARK OFFICE

CERTIFICATE OF CORRECTION

PATENT NO. : 8,123,009 B2
APPLICATION NO. : 12/473370
DATED : February 28, 2012
INVENTOR(S) : Richard C. Satterfield It is certified that error appears in the above-identified patent and that said Letters Patent is hereby corrected as shown below:

Col. 5, Claim 1, line 22, delete “attachment” and insert --alignment--.

Signed and Sealed this
Eighth Day of May, 2012

David J. Kappos

David J. Kappos
*Director of the United States Patent and Trademark Office*